US006172313B1

(12) United States Patent
Sakamoto et al.

(10) Patent No.: US 6,172,313 B1
(45) Date of Patent: Jan. 9, 2001

(54) ACCELERATION DETECTING DEVICE

(75) Inventors: Kazunori Sakamoto, Chiryu; Tateki Kawamura, Nagoya; Tsutomu Takeuchi, Gamagori; Koichi Fujita, Toyota, all of (JP)

(73) Assignee: Aisin Seiki Kabushiki Kaisha, Kariya (JP)

( * ) Notice: Under 35 U.S.C. 154(b), the term of this patent shall be extended for 0 days.

(21) Appl. No.: 09/210,991

(22) Filed: Dec. 15, 1998

(30) Foreign Application Priority Data

Dec. 15, 1997 (JP) ..... 9-344918

(51) Int. Cl.[7] ..... H01H 35/14
(52) U.S. Cl. ..... 200/61.48; 200/61.45 R
(58) Field of Search ..... 73/514.37; 200/61.45 R, 200/61.48

(56) References Cited

U.S. PATENT DOCUMENTS 5,034,580 * 7/1991 Tada et al. ..... 200/61.48
5,373,124 * 12/1994 Abendroth et al. ..... 200/61.45 R
5,389,751 * 2/1995 Breed ..... 200/61.45 R

FOREIGN PATENT DOCUMENTS 19523786 1/1996 (DE) .
08235980 9/1996 (JP) .
08235981 9/1996 (JP) .
08264088 10/1996 (JP) .

* cited by examiner

*Primary Examiner*—John E. Chapman
(74) *Attorney, Agent, or Firm*—Burns, Doane, Swecker & Mathis, LLP

(57) ABSTRACT

An acceleration detecting device includes a hollow housing having a side wall, a bottom wall and an opening and a cover closing the opening of the hollow housing. A weight is pivotally mounted in the hollow housing to be rotated about a locus in response to an applied acceleration. Also positioned within the housing is a contact assembly to be electrically-closed by the rotated weight. A plastic main body is held in the hollow housing along the side wall to support the contact assembly and keep the contact assembly spaced from the locus of the weight during the rotation of the weight. The plastic main body which supports the contact assembly may have a wider support along the side wall of the hollow housing, which is independent from fixture of the cover. Therefore, the contact assembly may be supported by the hollow housing through the main body in a more reliable manner. Further, the weight may rotate without any interference to the contact assembly because the contact assembly is kept off the locus of the weight.

15 Claims, 5 Drawing Sheets

ACCELERATION DETECTING DEVICE

This application corresponds to and claims priority under 35 U.S.C. §119 with respect to Japanese Application No. 09(1997)-344918 filed on Dec. 15, 1997, the entire content of which is incorporated herein by reference.

FIELD OF THE INVENTION

This invention generally relates to an acceleration or impact detecting device. More particularly, the present invention relates to an impact or acceleration detecting device that is adapted to detect the acceleration or impact associated with, for example, the collision of a vehicle for triggering a safety system such as a vehicle air bag system.

BACKGROUND OF THE INVENTION

Japanese Laid-Open Patent Publication No. 08-264088 published on Oct. 11, 1996 discloses an acceleration detecting device, that includes a hollow housing having a closed end and an open end, a weight pivotally supported in the hollow housing to be rotated in response to an applied acceleration, and a contact assembly electrically closed by the rotation of the weight. The open end of the hollow housing is closed by a cover that is pressed into the open end. The weight and the contact assembly are both supported by the cover.

However, in this known acceleration detecting device, the weight and the contact assembly may prevent the cover from sufficiently overlapping with the hollow housing. Accordingly, the cover may be inclined with respect to the hollow housing when a clearance is generated as a result of dimensional errors between the hollow housing and the cover. By virtue of such inclination, the weight and the contact assembly may interfere with the hollow housing. Although the cover may be thickened to enlarge the overlapping area between the hollow housing and the cover, this undesirably increases the size of the acceleration detecting device.

Accordingly, a need exists for an acceleration detecting device that is not susceptible of the same disadvantages and drawbacks noted above.

Thus, a need exists for an acceleration detecting device that is able to support the contact assembly in a more reliable manner.

Also, a need exists for an acceleration detecting device that permits the housing to be hermetically sealed with the cover.

SUMMARY OF THE INVENTION

In light of the foregoing, one aspect of the present invention includes an acceleration detecting device that includes a hollow housing having a side wall, a closed end and an open end, a cover closing the open end, a weight pivotally mounted inside the housing to be rotated about a locus in response to an applied acceleration, and a contact assembly that is adapted to be electrically closed through rotation of the weight. The contact assembly includes a main body held inside the hollow housing along the side wall to support the contact assembly and keep the contact assembly spaced from the locus of the weight during rotation of the weight.

In accordance with the present invention, the main body supporting the contact assembly can have wider support along the side wall of the hollow housing, which is independent from the cover fixture. Therefore, the contact assembly can be supported by the hollow housing through the main body in a more reliable manner. Further, the weight is able to rotate without any interference to the contact assembly because the contact assembly is kept off or spaced from the locus of the weight.

In accordance with another aspect of the present invention, an acceleration detecting device includes an enclosing device for enclosing an internal space, a movable element positioned in the internal space for moving along a locus in response to an applied acceleration, a detecting device for detecting movement of the movable element, and a holding mechanism for holding the detecting device in the internal space to keep the detecting device off the locus of the movable element.

BRIEF DESCRIPTION OF THE DRAWING FIGURES

Additional features and characteristics of the present invention will become more apparent from the following detailed description considered with reference to the accompanying drawing figures in which like elements are designated by like reference numerals and wherein.

DETAILED DESCRIPTION OF THE PREFERRED EMBODIMENT

Figure 1:
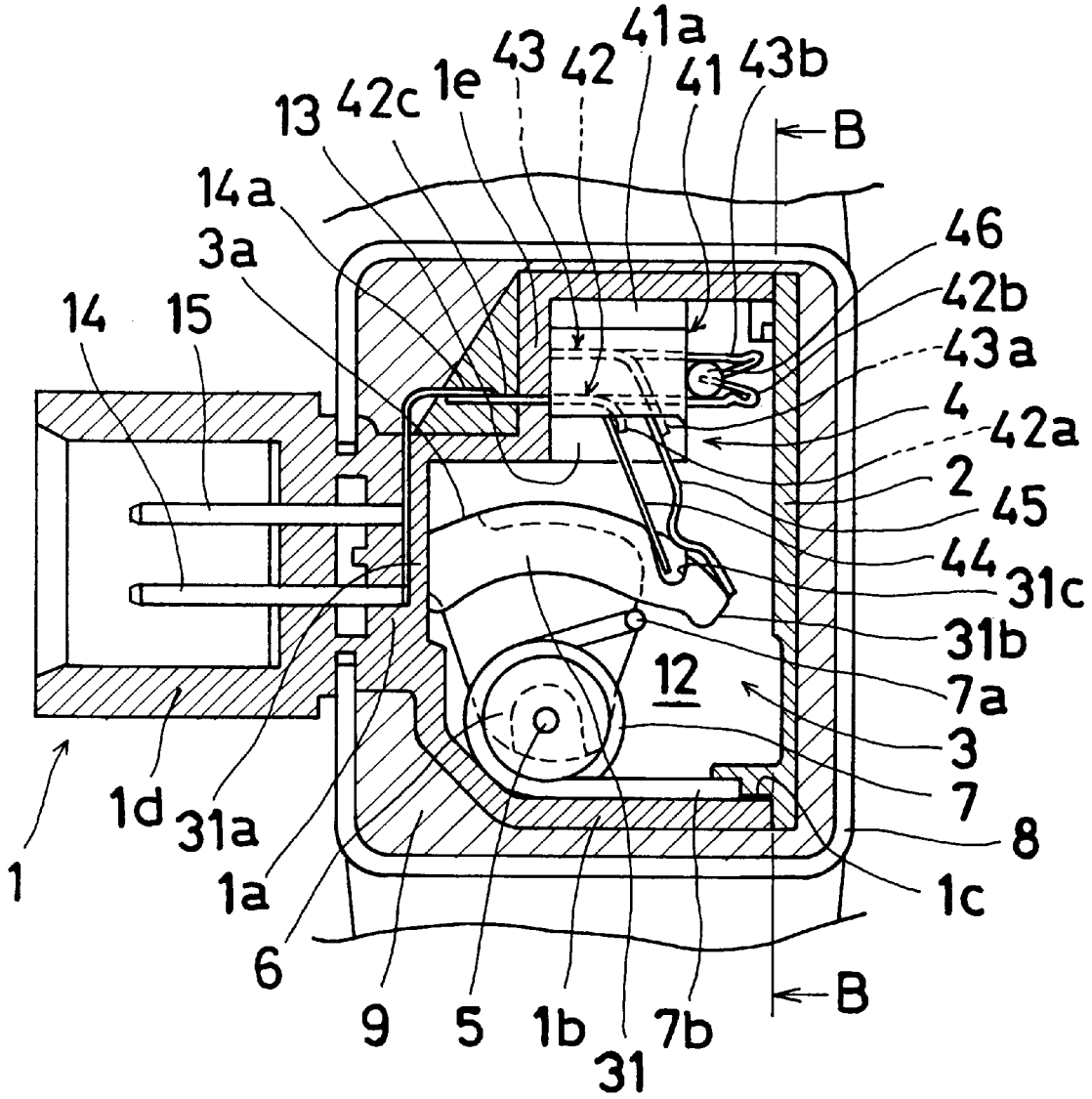
FIG. 1 is a cross sectional view of an acceleration detecting device according to the present invention.
Figure 2:
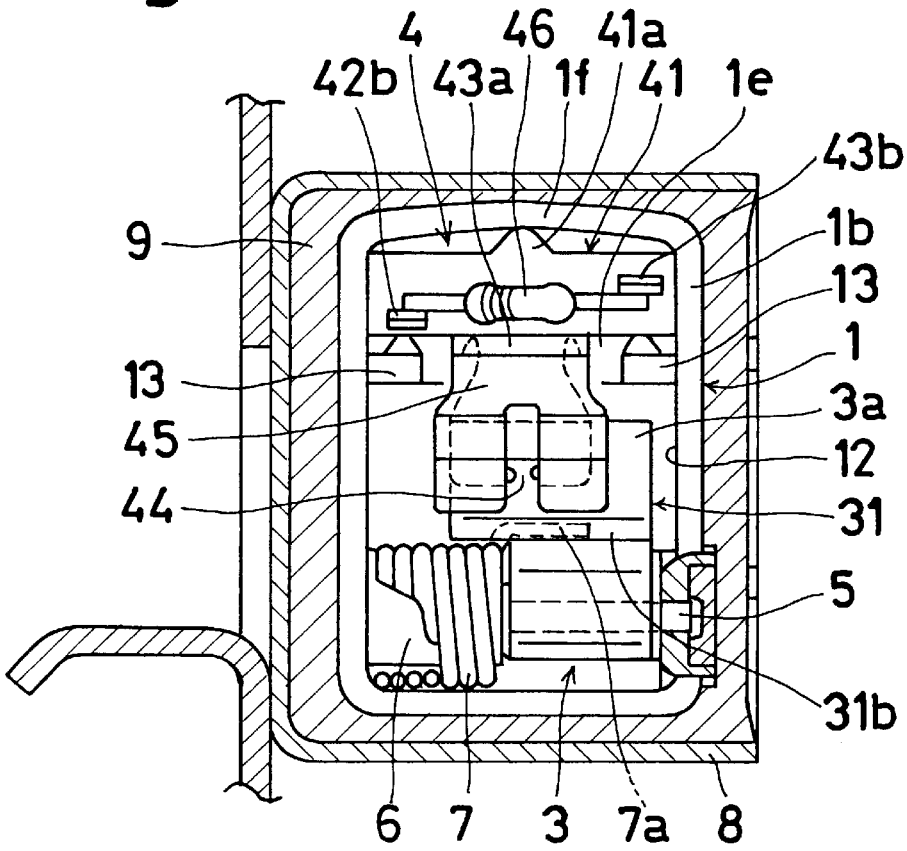
FIG. 2 is a cross sectional view taking along the section line II—II shown in FIG. 1.

As shown in FIGS. 1 and 2, the acceleration or impact detecting device of the present invention includes a hollow plastic housing 1 having a bottom wall 1*a* and a side wall 1*b*. The plastic housing is open at one end 1*c*. A connector portion 1*d* is integrally formed with the bottom wall 1*a* and extends from the bottom wall 1*a*. The open end 1*c* of the housing 1 is closed by a cover 2 that is joined with the side wall 1*b* by ultrasonic welding. The side wall 1*b* and the cover 2 are hermetically sealed to form an internal space 12 in which are mounted a weight 3 and a contact assembly 4. Further, a corner part between the bottom wall 1*a* and the side wall 1*b* is bent inwardly toward the internal space 12 to form a supporting portion 1*e* for the contact assembly 4.

The weight 3 possesses a sector-like shape and is pivotally supported by a pin 5 at an apex or central part thereof. Both ends of the pin 5 are supported by the side wall 1*b* of the housing so that the weight 3 is held in the internal space 12.

A plastic portion 31 is integrally molded to the weight 3. The plastic portion 31 possesses an arc-shaped circumference 3*a*. Stopper portions 31*a*, 31*b* are formed at the respective circumferential ends of the plastic portion 31. The stopper portions 31*a*, 31*b* project from the sides of the weight 3 and are able to touch the bottom wall 1*a* and the side wall 1*b* of the housing in different operational positions of the weight 3.

The pin 5 is surrounded by a collar 6 and a spring 7. The spring 7 is wound around the collar 6. One end 7*a* of the spring 7 hooks around a portion of the weight 3 at the side of the stopper portion 31*b*. The other end 7*b* of the spring 7 extends along the side wall 1*b* of the housing 1 and hooks onto one end of the cover 2. The spring 7 thus applies a biasing force to the weight 3 causing the weight to return to an initial position at which the stopper portion 31*a* touches or engages the bottom wall 1*a*.

The contact assembly 4 includes a plastic main body 41, a first coupler 42 and a second coupler 43. The main body 41 is pressed into a space that is provided between or defined by the side wall 1*b* and a pair of projections 13 so that the main body 41 contacts or engages the supporting part 1*e*. In other words, the main body 41 is held by the housing 1 with the side wall 1*b*, the projections 13 and the mounting part 1*e*. The projections 13 form a partition that divides the internal space of the housing 1 into one space in which is located the contact assembly 4 and another space in which is located the weight 3. The projections 13 are integrally formed with the bottom wall supporting part 1*e* and extend toward the cover 2 in parallel with the side wall 1*b*.

The first and second couplers 42, 43 are embedded in the main body 41 and form a contact mechanism that is adapted to be electrically closed through rotation of the weight 3 as described below in more detail. The first coupler 42 includes first and second forks 42*a*, 42*b* and the second coupler 43 has first and second forks 43*a*, 43*b*. The first forks 42*a*, 43*a* are bent to project from the main body 41 toward the arc-shaped circumference 3*a* of the weight 3. First and second electrodes 44, 45 are mechanically and electrically joined with the first forks 42*a*, 43*a*. The first and second electrodes 44, 45 extend toward the weight 3, generally in parallel with one another. The second electrode 45 includes an arcuate shaped portion and contacts the arc-shaped outer circumference 3*a* of the weight 3. One end of the first electrode 44 is positioned in a groove 31*c* that is formed on the arc-shaped outer circumference 3*a* of the weight 3. The first electrode 44 selectively contacts the second electrode 45 depending on the position of the weight 3. Although the first and second electrodes 44, 45 are designed separately from the first and second couplers 42, 43 in this embodiment, it is within the purview of a skilled artisan to integrally form the first and second electrodes 44, 45 with the first and second couplers 42, 43 by forming the electrodes 44, 45 as extensions of the first and second couplers 42, 43.

The second forks 42*b*, 43*b* extend and project from the main body 41 toward the cover 2. An electrical resistor 46 is connected between the second forks 42*b*, 43*b*. In this way, the electrical resistance between the first and second couplers 42, 43 may be changed and detected by an external device (not shown) depending on the position of the weight 3. While the first electrode 44 contacts the second electrode 45, the first and second couplers 42, 43 are electrically connected by the first and second electrodes 44, 45 so that the external device detects a low electric resistance. On the other hand, when the first electrode 44 is not in contact with the second electrode 45, the external device detects a high electric resistance generated by the electrical resistor 46. In the event the external device detects a non-conductive state between the first and the second couplers 42, 43, it would likely be an indication that a wire is broken somewhere between the external device and the first and the second couplers 42, 43.

Figure 3:
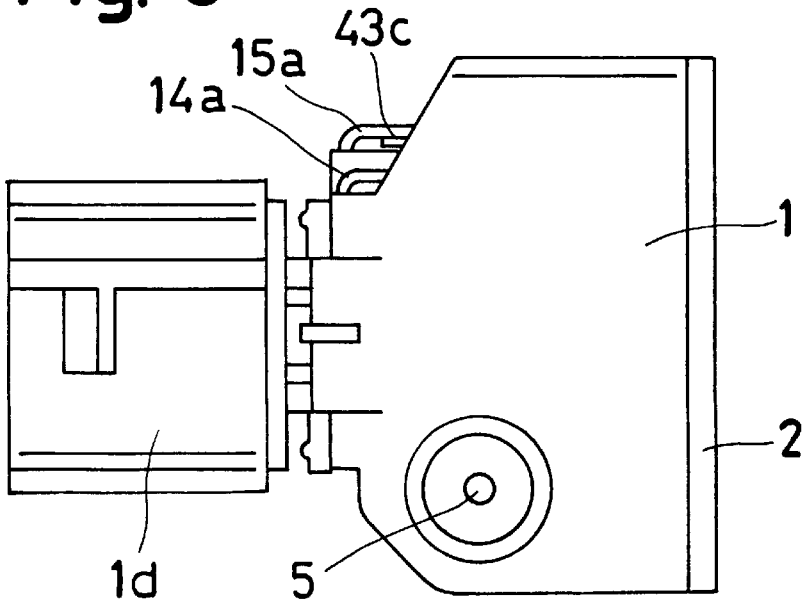
FIG. 3 is a front view of an acceleration detecting device according to the present invention.
Figure 4:
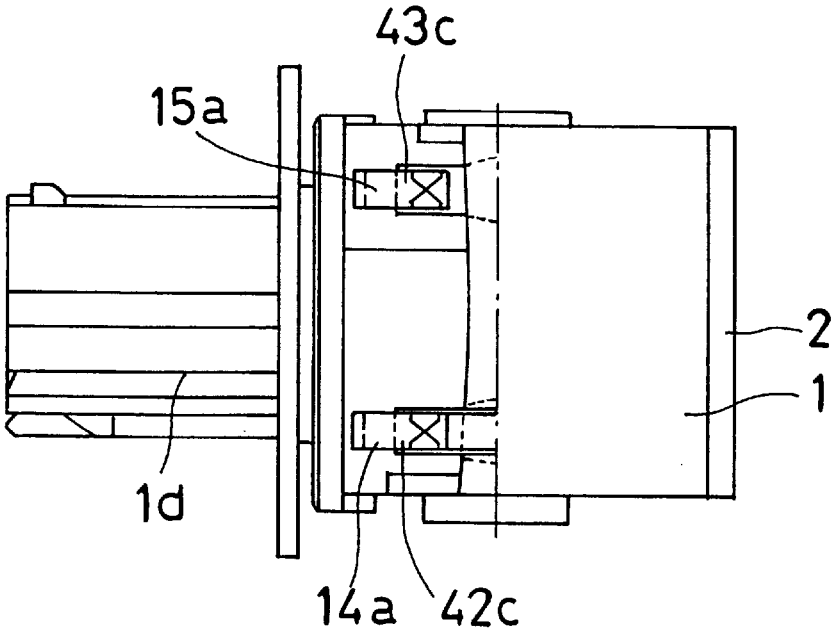
FIG. 4 is a top view of an acceleration detecting device according to the present invention.
Figure 5:
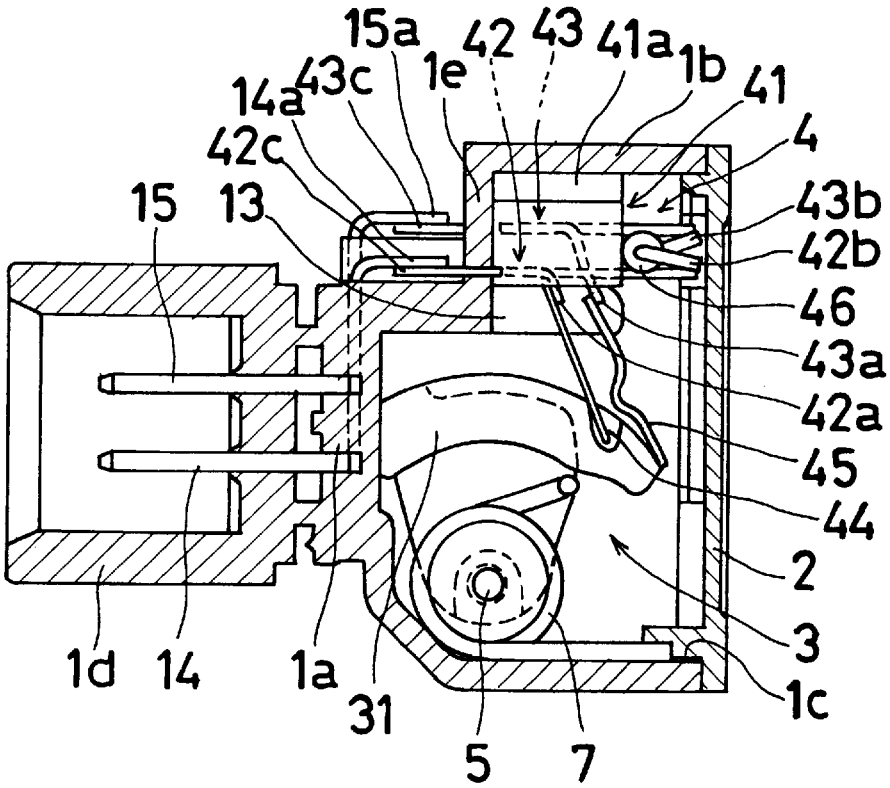
FIG. 5 is a cross sectional view of the acceleration detecting device shown in FIG. 3.

As shown in FIGS. 3, 4 and 5, the end 42*c* of the first coupler 42 and the end 43*c* of the second coupler 43 extend through and project from the supporting portion 1*e* of the housing 1. A first terminal 14 and a second terminal 15 are embedded in the connector portion 1*d* of the housing 1. The respective ends 14*a*, 15*a* of the terminals 14, 15 extend through and project from the housing 1. The end portions of the terminals 14, 15 approaching the ends 14*a*, 15*a* of the terminals 14,15 are arranged substantially perpendicular to the ends 42*c*, 43*c* of the couplers 42, 43, with the ends 14*a*, 15*a* of the terminals 14, 15 being bent towards the couplers 42, 43 as shown in FIG. 5. The ends 14*a*, 15*a* of the terminals 14, 15 are mechanically and electrically connected to the ends 42*c*, 43*c* of the couplers 42, 43 by laser welding or resistance welding. In this way, the electrical resistance may be detected by the external device through connection with the first and second terminals 14, 15.

As shown in FIGS. 1 and 2 and briefly mentioned above, the groove 31*c* is formed on the arc-shaped outer circumference 3*a* of the weight 3. The groove 31*c* opens to the arc-shaped outer circumference 3*a* of the weight and extends in the thickness direction of the weight 3 (i.e., in the right-left direction as seen with reference to FIG. 2). One end of the first electrode 44 is inserted in the groove 31*c*. The first electrode 44 does not contact the second electrode 45 while the first electrode 44 is located in the groove 31*c* so that the first and second couplers 42, 43 exhibit the highest electrical resistance.

The contact assembly 4 is assembled within the housing 1 in the following manner. First, the weight 3 is mounted within the housing 1 by way of the pin 5. The contact assembly 4 is inserted in the internal space 12 of the housing 1 from the opening 1*c* along the side wall 1*b*. The main body 41 is pressed into the space that is provided between the projections 13 and the side wall 1*b*. The contact assembly 4 is thus tightly held on or against the mounting part 1*e* of the housing 1. At the same time, a triangular projection 41*a* of the main body 41 engages an outwardly projecting portion if of the side wall 1*b*. By virtue of the engagement between the triangular projection 41*a* and the projecting portion 1*f* of the side wall 1*a*, the exact position of the main body 41 is easily assured. As explained, the contact assembly 4 is held by the side wall 1*b* of the housing 1 with a relatively broad area and so less play will exist between the contact assembly 4 and the housing 1.

After insertion of the main body 41, the ends 42*c*, 43*c* of the first and second couplers 42, 43 can be mechanically and electrically connected to the ends 14*a*, 15*a* of the first and second terminals 14, 15 which are embedded in the housing 1. After the connections between the couplers 42, 43 and the terminals 14, 15 has been made, the main body 41 is no longer capable of coming out from the housing 1. Finally, the cover 2 is joined with or connected to the housing 1 by ultrasonic welding. The first and second couplers 42, 43 are not affected by the ultrasonic welding and the internal space 12 of the housing 1 is hermetically sealed in a reliable manner because the first and second couplers 42, 43 are held by the housing 1 and are not able to contact the cover 2.

The housing 1 is stored in the metal case 8 as shown in FIG. 2 after the weight 3 and the contact assembly 4 are disposed in the housing 1. The inside of the metal case 8 is filled with a sealant 9 to seal up the housing 1. The metal case 8 can then be mounted on an automobile body as partially shown in FIG. 2.

Figure 6:
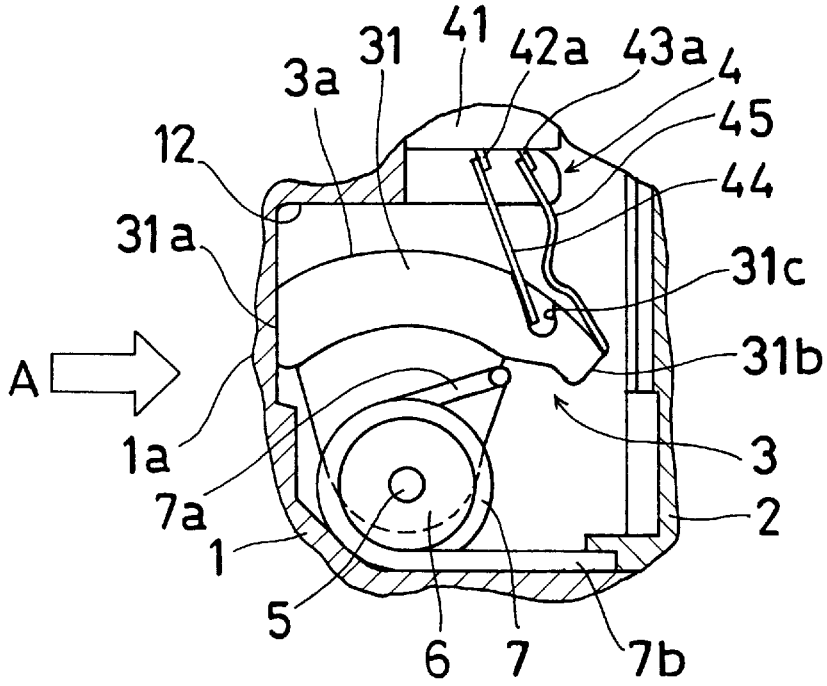
FIG. 6 is a partial cross sectional view of the acceleration detecting device showing one operation state of the device according to the present invention.

Referring now to FIGS. 6, 7, 8 and 9, the operation of the acceleration or impact detecting device of the present invention will be described. FIG. 6 shows the condition of the acceleration detecting device where no acceleration is applied to the weight 3. In this condition, the weight 3 receives the biasing force from the spring 7 so that the weight 3 is positioned in the initial position of which the stopper portion 31*a* of the weight 3 touches or contacts the bottom wall 1*a* of the housing 1. In this initial position, the one end of the first electrode 44 is positioned in the groove 31*c* of the weight 3 so that the first electrode 44 is separated from the second electrode 45. Also, one end of the second electrode 45 rests on the arc-shaped out circumference 3*a* of the weight 3. No electrical connection is made between the first and second electrodes 44, 45 and so the electrical resistance between the first and second couplers 42, 43 is high.

Figure 7:
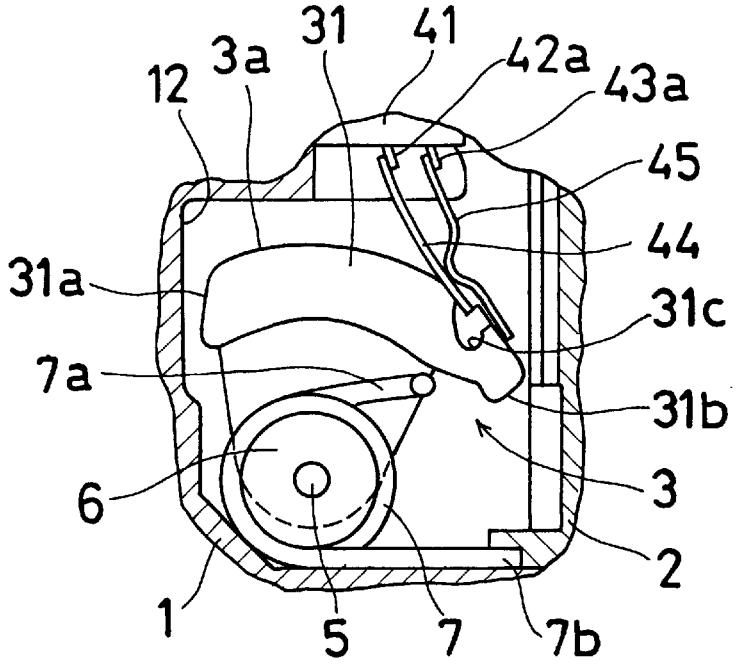
FIG. 7 is a partial cross sectional view of the acceleration detecting device showing another operation state of the device according to the present invention.
Figure 9:
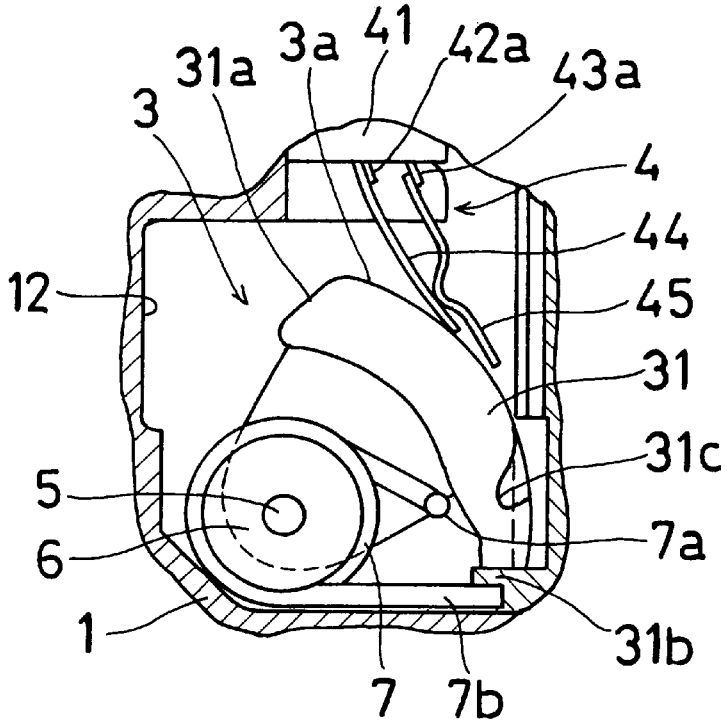
FIG. 9 is a partial cross sectional view of the acceleration detecting device showing another operation state of the device according to the present invention.

When an acceleration A (see FIG. 6) exceeding a predetermined value occurs due to, for example, a collision of the vehicle, the weight 3 rotates against the biasing force of the spring 7 and the inertia force of the weight 3 until the stopper part 31*b* of the weight 3 touches the side wall 1*b* of the housing 1 as shown in FIG. 9. While the weight 3 rotates, as shown in FIG. 7, the first electrode 44 moves out of the groove 31*c* of the weight 3 so that the first electrode 44 slides along the arc-shaped outer circumference 3*a* of the weight 3. As the weight 3 rotates to cause the first electrode 44 to move out of the groove 31*c*, the first electrode 44 bends and eventually contacts the second electrode 45. Thus, the first coupler 42 is electrically connected to the second coupler 43. The excessive acceleration is thus detected as a result of a decrease in the electric resistance between the first and the second couplers 42, 43.

Figure 8:
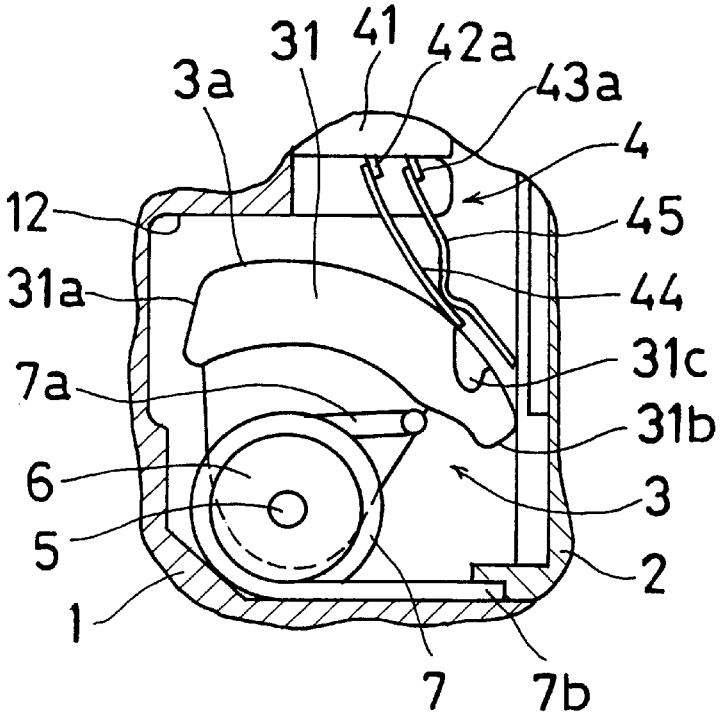
FIG. 8 is a partial cross sectional view of the acceleration detecting device showing another operation state of the device according to the present invention.

During the rotation of the weight 3 shown in FIGS. 7, 8 and 9, the first electrode 44 slides along the arc-shaped outer circumference 3*a* of the weight 3 as shown in FIG. 8. While the first electrode 44 slides along the arc-shaped outer circumference 3*a* of the weight 3, the second electrode 45 is pushed and bent by the first electrode 44 so that the second electrode 45 moves away from the arc-shaped outer circumference 3*a*. That is, the first electrode 44 is pinched between the second electrode 45 and the arc-shaped outer circumferential surface 3*a* of the weight 3 so that the spring force associated with the second electrode 45 maintains electrical contact between the first and second electrodes 44, 45. Because the distance between the arc-shaped outer circumference 3*a* of the weight and the rotational center of the weight 3 is maintained constant, the first and second electrodes 44, 45 cannot bend beyond that which is necessary while the first electrode 44 slides on the arc-shaped outer circumference 3*a* of the weight 3.

As explained, the electrical contact between the first and second electrodes 44, 45 is reliably maintained during rotation of the weight 3 so that momentary non-contact or chattering between the first and second electrodes 44, 45 may be reliably prevented from being generated. Further, because the arc-shaped outer circumference 3*a* of the weight 3 is a part of the plastic portion 31, the first electrode 44 is able to easily slide on the arc-shaped outer circumference 3*a* of the weight 3. Thus, the weight 3 is able to rotate very smoothly.

After the acceleration in the direction A disappears, the weight 3 is able to rotate in the reverse direction so that the weight 3 returns to the initial position shown in FIG. 6. As already explained, at the initial position of the weight 3, the stopper portion 31*a* touches the bottom wall 1*a* of the housing 1. Accordingly, the one end of the first electrode 44 once again enters the groove 31*c* in the outer circumferential surface of the weight 3 to disengage the first electrode 44 from the second electrode 45. Thus, the high electrical resistance between the first and second couplers 42, 43 is once again detected.

According to the present embodiment, the plastic main body 41 which supports the contact assembly 4 may have a wider support along the side wall 1*a* of the hollow housing 1, which is independent from the fixture of the cover 2. Therefore, the contact assembly 4 may be supported by the hollow housing 1 through the main body 41 in a more reliable manner. Further, the weight 3 may rotate without any interference to the main body 41 because the main body 41 is kept off or spaced from the locus of the weight 3.

Also, the plastic main body 41 is pressed into the space that is provided between the side wall 1*b* and the pair of projections 13 until the main body 41 contacts the mounting part 1*e*. Because the side wall 1*b*, the projections 13 and the mounting part 1*e* are integrally formed as parts of the housing 1, the first and second couplers 42, 43 may be more rigidly supported by the housing 1.

Additionally, the first and second couplers 42, 43 are mechanically and electrically joined with the first and second terminals 14, 15 by, for example, welding. Thus, the first and second couplers 42, 43 will not come out from the housing 1 after the mechanical connection (e.g., welds) has been made.

Further, the opening 1*c* in the housing 1 is closed by the cover 2 which is joined with the side wall 1*b* by ultrasonic welding. Therefore, the first and second couplers 42, 43 will not be adversely affected by the ultrasonic welding. In addition, the internal space 12 of the housing 1 is hermetically sealed in a reliable manner.

The principles, a preferred embodiment and the mode of operation of the present invention have been described in the foregoing specification. However, the invention which is intended to be protected is not to be construed as limited to the particular embodiment described. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. An acceleration detecting device comprising:

a hollow housing having a side wall, a closed end and an open end;

a cover closing the open end of the housing;

a weight pivotally mounted inside the hollow housing for rotating along a locus in response to an applied acceleration; and a contact assembly adapted to be electrically closed through rotation of the rotated weight, the contact assembly including a main body and a pair of contacts embedded in the main body, the main body being positioned in the hollow housing along the side wall to support the contact assembly and keep the main body of the contact assembly off the locus of the weight during rotation of the weight.

2. The acceleration detecting device according to claim 1, wherein the hollow housing further includes a projection extending parallel with the side wall, the main body being pinched between the projection and the side wall.

3. The acceleration detecting device according to claim 1, including a connector for outputting electrical signals, terminals embedded in the connector, and couplers embedded in the main body to transmit electrical signals, the couplers being joined with the terminals to provide mechanical connection between the main body and the connector and electrical connection between the terminals and the couplers.

4. The acceleration detecting device according to claim 1, wherein the cover is joined to the open end of the housing by ultrasonic welding.

5. An acceleration detecting device comprising:

enclosing means for enclosing an internal space, said enclosing means including a sidewall;

moving means positioned in the internal space for moving along a locus in response to an applied acceleration;

detecting means for detecting the movement of the movement means;

said detecting means including a main body and a pair of contacts embedded in the main body, the main body being positioned in the enclosing means along the side wall; and holding means for holding the main body in the internal space to keep the main body of the detecting means off the locus of the moving means.

6. The acceleration detecting device according to claim 5, wherein the enclosing means includes partitioning means for partitioning the internal space into a first space and a second space, the moving means being located in the first space and the holding means being located in the second space.

7. The acceleration detecting device according to claim 5, including connecting means electrically and mechanically connected to the detecting means for outputting a detection signal.

8. The acceleration detecting device according to claim 5, wherein the enclosing means includes an open end, said main body being spaced from said open end.

9. The acceleration detecting device according to claim 5, wherein said enclosing means includes an open end, and including a cover covering the open end.

10. An acceleration detecting device comprising:

a hollow housing having an open end and possessing a side wall having an outwardly projecting side wall portion;

a cover closing the open end of the housing;

a weight pivotally mounted inside the hollow housing for rotating in response to an applied acceleration;

a holder positioned within the hollow housing, said holder being separate from the hollow housing and secured in place within the hollow housing, said holder including a projection that engages the outwardly projecting side wall portion; and a pair of electrodes mounted in the holder, said electrodes having end portions that are spaced apart from one another in a non-operational position of the weight, with the end portion of one of said electrodes being moved into contact with the end portion of the other electrode upon rotation of the weight.

11. The acceleration detecting device according to claim 10, wherein the hollow housing possesses a bottom wall and at least one projection extending inwardly from the bottom wall, said holder being held between the side wall and the at least one projection.

12. The acceleration detecting device according to claim 10, wherein the hollow housing includes a connector portion in which are disposed a pair of exposed terminals, said terminals being connected to the pair of electrodes.

13. The acceleration detecting device according to claim 10, including a spring which applies a biasing force to the weight to urge the weight towards the non-operational position, a portion of said spring being held between the cover and a side wall of the housing.

14. The acceleration detecting device according to claim 10, including a connector portion forming a part of the housing, and terminals exposed at the connector, said terminals being connected to the electrodes.

15. The acceleration detecting device according to claim 10, wherein the cover is connected to the open end of the housing by ultrasonic welding.

* * * * *